US007888613B2

(12) United States Patent
Jeffery et al.

(10) Patent No.: US 7,888,613 B2
(45) Date of Patent: Feb. 15, 2011

(54) FLEXIBLE LIGHT GUIDE FOR MEMBRANE SWITCH

(75) Inventors: Peter Andrew Jeffery, Huntington Beach, CA (US); Jason Tsi-Tsun Lin, Rosemead, CA (US)

(73) Assignee: CoActive Technologies, Inc., Newton, MA (US)

( * ) Notice: Subject to any disclaimer, the term of this patent is extended or adjusted under 35 U.S.C. 154(b) by 490 days.

(21) Appl. No.: 12/017,799

(22) Filed: Jan. 22, 2008

(65) Prior Publication Data

US 2008/0197002 A1 Aug. 21, 2008

Related U.S. Application Data

(60) Provisional application No. 60/881,932, filed on Jan. 22, 2007.

(51) Int. Cl.
*H01H 9/00* (2006.01)

(52) U.S. Cl. ..... 200/314; 200/516

(58) Field of Classification Search ..... 200/314, 200/317, 406, 512, 516; 362/29
See application file for complete search history.

(56) References Cited

U.S. PATENT DOCUMENTS

| | | | | |
|---|---|---|---|---|
| 3,967,084 | A | 6/1976 | Pounds | |
| 4,042,439 | A | 8/1977 | Pounds | |
| 4,046,975 | A | 9/1977 | Seeger, Jr. | |
| 4,958,148 | A * | 9/1990 | Olson | 345/174 |
| 5,669,486 | A | 9/1997 | Shima | |
| 5,871,088 | A | 2/1999 | Tanabe | |
| 5,924,555 | A | 7/1999 | Sadamori et al. | |
| 6,369,801 | B2 | 4/2002 | Boireau et al. | |
| 6,373,008 | B1 | 4/2002 | Saito et al. | |
| 6,593,537 | B2 * | 7/2003 | Teruyama et al. | 200/515 |
| 6,595,653 | B2 | 7/2003 | Saito et al. | |
| 6,703,463 | B2 | 3/2004 | Holguin et al. | |
| 6,861,600 | B1 | 3/2005 | Schulz et al. | |
| 6,926,418 | B2 | 8/2005 | Ostergard et al. | |
| 6,927,352 | B2 | 8/2005 | Bouche et al. | |
| 7,070,349 | B2 | 7/2006 | Dombrowski et al. | |
| 7,106,936 | B2 | 9/2006 | Saccomanno | |
| 2005/0120025 | A1 | 6/2005 | Rodriguez et al. | |
| 2007/0013664 | A1 | 1/2007 | Lee et al. | |
| 2007/0057031 | A1 | 3/2007 | Lee | |
| 2007/0257822 | A1 | 11/2007 | Lee et al. | |

FOREIGN PATENT DOCUMENTS

| | | | |
|---|---|---|---|
| EP | 1729205 | A | 12/2006 |

* cited by examiner

*Primary Examiner*—Edwin A. Leon
*Assistant Examiner*—Vanessa Girardi
(74) *Attorney, Agent, or Firm*—Pepper Hamilton LLP

(57) ABSTRACT

In an embodiment, a membrane switch may include a flexible light guide having a first refractive index. The flexible light guide may include a first wall, an opposing second wall, and one or more additional walls. One or more of the first wall, the second wall and the additional walls may be disposed adjacent to a substance including a second refractive index that is lower than the first refractive index.

19 Claims, 3 Drawing Sheets

FLEXIBLE LIGHT GUIDE FOR MEMBRANE SWITCH

RELATED APPLICATIONS AND CLAIM OF PRIORITY

This patent application claims priority to U.S. Provisional Application No. 60/881,932, filed Jan. 22, 2007, the disclosure of which is incorporated herein by reference in its entirety.

BACKGROUND

Traditional membrane switches work in conjunction with a light guide and a light source to produce backlighting for a keypad or control panel. FIG. 1 illustrates a portion of a prior art membrane switch assembly 10 such as the type used in cell phones. Pairs of contacts 12, 14 are positioned at spaced locations on a circuit board 16. A snap dome 20 is positioned over each pair of contacts, with the periphery 22 of each snap dome lying on and in constant contact with the outer contact 12. The middle 24 of each snap dome is positioned over a middle contact 14 and touches the middle contact 14 when the snap dome is depressed. This causes the middle contact 14 to engage the outer contact 12. Although a non-snap dome may be used, a snap dome is often used because it provides tactile feedback to the person who depresses it. The upper surfaces of the domes 20 are adhesively fastened to a flexible carrier sheet 30 which are used to hold the domes 20 in selected positions over the pairs of contacts.

A manually depressable key 32 with an identification marking 34 on its upper surface has a transparent or translucent downward projection 36. When the key 32 is depressed, the projection 36 depresses a location on the carrier sheet 30, which depresses the middle 24 of the dome 20 to cause contacts 12 and 14 to close the switch that corresponds to that key. When the depressing force is no longer applied, the dome, a portion of the carrier sheet 30 and the key 32 revert to their original positions. A light guide 40 is mounted above the carrier sheet and has a hole 42 aligned with the carrier sheet portion that is positioned above a dome. The key projection 36 projects through the hole 42. The light guide carries light from a light source and releases some of the light at the hole 42, to pass through and around the projection to illuminate the key.

FIG. 2 is a sectional view of a switch of the assembly of FIG. 1. The membrane switch includes a spacer 50 and two adhesive layers 52, 54 that hold the carrier sheet 30 so it is raised above the circuit board 16 to allow venting of air beneath the dome, and to hold the carrier sheet in place on the circuit board. Lines 61-63 show the paths of light passing from the light source 64 along the light guide 40. The light guide may be fastened by screws to the circuit board or held down by the device housing. FIG. 2 depicts the dome 20 in its quiescent position. Line 20A shows the dome in a depressed or activated position.

Traditional thin light guides caused light to scattered or absorbed and not reflected upward toward the key. Additionally, light from the light source is typically lost inside the membrane switch since oftentimes the brightest part of the light source shines into layers of the membrane switch instead of into the light guide.

SUMMARY

In an embodiment, a membrane switch may include a flexible light guide having a first refractive index. The flexible light guide may include a first wall, an opposing second wall, and one or more additional walls. One or more of the first wall, the second wall and the additional walls may be disposed adjacent to a substance including a second refractive index that is lower than the first refractive index. The substance having the second refractive index may be disposed adjacent to the first wall.

In an embodiment, the first wall may include an uneven surface which may manage light reflected from the second wall. The uneven surface may include at least one of a plurality of bumps, dimples, scratches, hash marks, textures, depressions, and/or holes. In an embodiment, the first wall may include a patterned surface which may manage light reflected from the second wall. The first wall of the membrane switch may include one or more moveable contacts. In an embodiment, the membrane switch may include one or more moveable contacts which may be attached directly to the first wall via an adhesive layer. In an alternate embodiment, the membrane switch may include one or more moveable contacts which may be attached to the substance having the second refractive index.

In an embodiment, the membrane switch may include a movable contact which may be disposed such that movement of the first wall may move the movable contact. The membrane switch may also include a circuit board which may include a plurality of fixed electrical contacts. The moveable contact may be positioned over a first one of the fixed electrical contacts so that the moveable contact may touch the first fixed electrical contact when depressed and may not touch the first fixed electrical contact when relaxed. In an embodiment, a substance having the second refractive index may be disposed adjacent to the second wall. In an embodiment, a reflective material may be disposed adjacent to the substance having the second refractive index. In an embodiment, the reflective material may be specular.

In an alternate embodiment, a dome sheet may include a light guide, a plurality of moveable contacts and a patterned adhesive. The patterned adhesive may bond the light guide to the moveable contacts so that the patterned adhesive forms one or more gaps between the moveable contacts and the light guide. In an embodiment, the light guide may include a first wall and an opposing second wall. In an embodiment, the first wall may be bonded to the patterned adhesive and the first wall may include an uneven surface. The uneven surface of the first wall may include at least one of a plurality of bumps, dimples, scratches, hash marks, applied patterns, textures, depressions, and/or holes. In an embodiment, the first wall may be bonded to the patterned adhesive and the first wall may include a patterned surface.

In one embodiment, one or more gaps in the patterned adhesive may form a channel between a plurality of moveable contacts. The second wall may include a flexible, reflective material. The patterned adhesive may include a plurality of adhesive regions having a reflective property and position so that at least some light, when reflected from any of the regions, may be reflected at an angle less than a critical angle of the light guide. The regions may be positioned so that the one or more gaps cause total internal reflection inside the light guide. In an embodiment, one or more gaps may be sealed inside the dome sheet. In an embodiment, the dome sheet may include a spacer. The spacer may be positioned to attach to the light guide in areas where no movable contacts are in contact with the light guide. In an embodiment, the patterned adhesive may include a light reflecting adhesive.

In an alternate embodiment, a membrane switch may include a circuit board including a plurality of fixed electrical contacts, a moveable contact positioned over a first one of the fixed electrical contacts so that the moveable contact may touch the first fixed electrical contact when depressed and may not touch the first fixed electrical contact when relaxed, a patterned adhesive bonded to the moveable contact and a light guide bonded to the patterned adhesive. The patterned adhesive may bond the light guide to the moveable contact so that the patterned adhesive forms one or more gaps between the moveable contact and the light guide.

DETAILED DESCRIPTION

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

The term "adhesive" refers to a compound that binds one object to a second object, either permanently or in a manner that will allow the objects to be separated upon application of an appropriate force.

The term "light guide" refers to a sheet of material that receives light from an external source, propagates light from the point of entry throughout the sheet, and distributes light so that light is provided over the surface area of the sheet.

The term "refraction" refers to the bending of light. Because light travels at different speeds in different materials, such as air and liquid, refraction may occur at the interface of the materials.

The terms "refractive index" and "index of refraction" refer to a measure of how much the speed light is reduced within a substance. When light moves from a substance having a first refractive index to a substance having a second refractive index, the speed at which the light travels changes and the light bends in a new direction. The measure of bending or refracting of light upon its entry to a medium determines the index of the medium.

The terms "positioned over" and "positioned under" define a location based relationship between two objects. The term "positioned over" includes positioned above, positioned next to, and positioned below. Similarly, the term "positioned under" includes positioned above, positioned next to, and positioned below. For example, if item X has object A positioned above object B, object A is still positioned above object B if item X is turned upside down or if item X is turned on its side.

Figure 1:
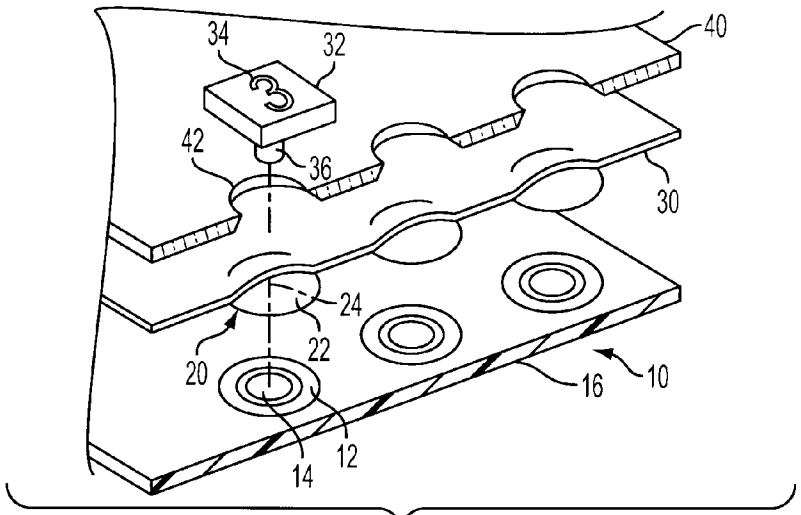
FIG. 1 PRIOR ART
FIG. 1 illustrates a portion of a prior art membrane switch.
Figure 2:
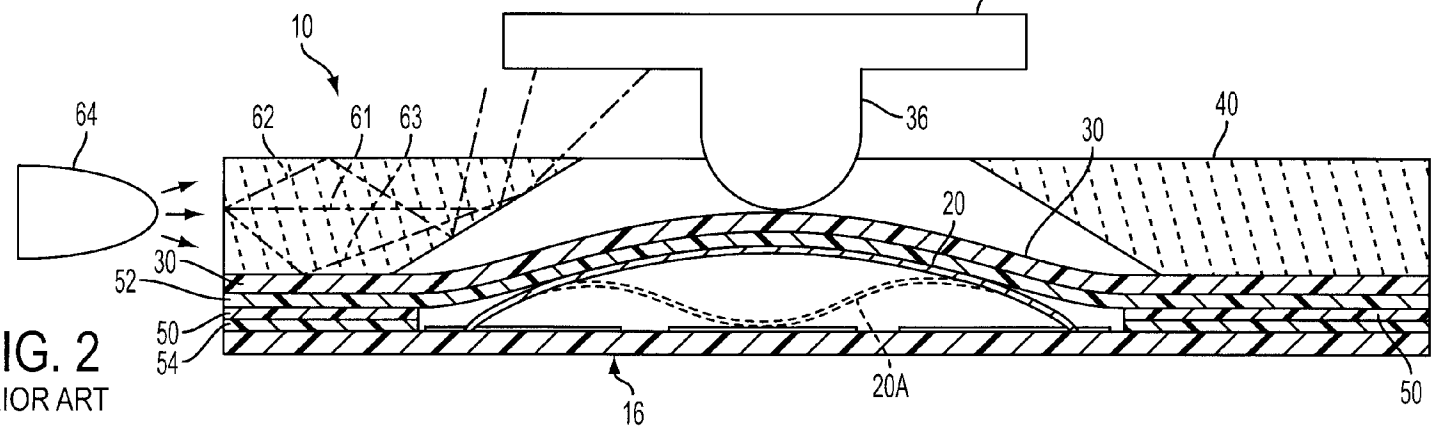
FIG. 2 PRIOR ART
FIG. 2 depicts a sectional view of a switch of the assembly of FIG. 1.
Figure 3:
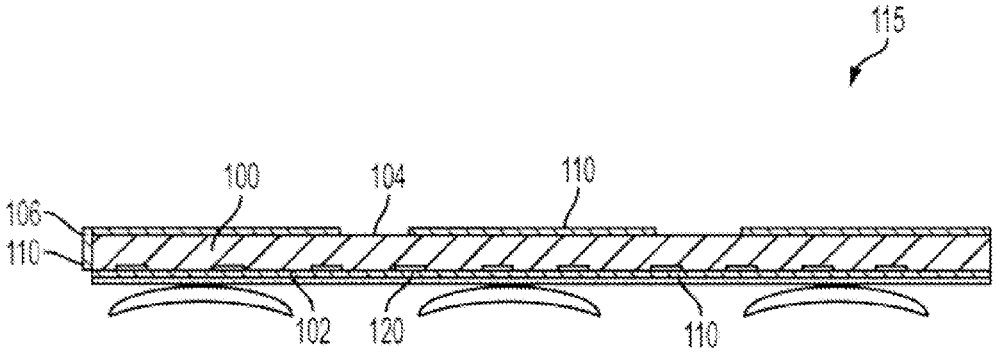
FIG. 3 depicts a sectional view of an exemplary dome sheet according to an embodiment.

FIG. 3 depicts a sectional view of an exemplary dome sheet 115 according to an embodiment. A dome sheet 115 may include a light guide 100. A light guide 100 may be made of a flexible material such as, but not limited to, polycarbonate. A light guide 100 may include, but is not limited to, optically clear membranes. In an embodiment, a light guide 100 may be half a millimeter thick or less, although other sizes are possible. A light guide 100 may include a first wall 102, an opposing second wall 104 and one or more additional walls 106. In an embodiment, additional walls 106 may be located between a first wall 102 and a second wall 104. In an embodiment, any of the walls may be made of multiple segments that together make up the corresponding wall. In an embodiment, multiple walls may be used to connect a first wall 102 to a second wall 104.

A light guide 100 will have a refractive index that depends on the material from which the light guide 100 is made. In an embodiment, a wall of a light guide 100 may be disposed adjacent to a solid or liquid substance 110 having a different index than the refractive index of the light guide 100. In an embodiment, the substance can serve as a support, an adhesive, and/or a spacer. In an embodiment, the refractive index of the substance 110 may be lower than the refractive index of the light guide 100 to promote total internal reflection. For example, a substance 110 may have a refractive index greater than 1, but less than the refractive index of the light guide 100. In another example, a substance 110 may have a refractive index of 1.47 or less, while the light guide 100 may have a higher refractive index. In some embodiments, the material of the substance may be of any suitable material such as, but not limited to, a fluoropolymer. In an embodiment, a substance 110 may be disposed adjacent to all or one or more portions of any of the following: a first wall 102, a second wall 104 and/or one or more additional walls 106 of a light guide 100. When light within the light guide 100 travels into a substance 110, at least a portion of the light will be reflected back into the light guide.

In an embodiment, one or more walls of a light guide 100 may be physically formed to deviate from a uniform, smooth, flat surface. In an embodiment, one or more walls of a light guide 100 may include an uneven and/or patterned surface 120. In an embodiment, a substance, such as, but not limited to, an adhesive or a patterned adhesive, may be placed on a light guide 100 to create an uneven and/or patterned surface 120. An uneven and/or patterned surface may occur on one or more of: a first wall 102, a second wall 104 and/or one or more additional walls 106 of a light guide 100. In an embodiment, a second wall of a light guide 100 may include an uneven and/or patterned surface, which may be used to manage light reflected from a first wall 102 of the light guide 100. An uneven and/or patterned surface 120 may include a plurality of bumps, dimples, scratches, hash marks, applied patterns, textures, depressions, holes and/or other features that yield a non-smooth surface. An applied pattern may be applied by methods including, but not limited to, printing, spraying or sputtering. The uneven and/or patterned surface may cause reflection within the light guide, optionally so that light is reflected back into the light guide with similar luminescence in multiple directions. The scatter of light may improve the uniformity and brightness of the light throughout the length of the light guide 100. In an embodiment, the scatter of light from the uneven surface may be used to illuminate a key or button placed above the light guide 100. An uneven and/or patterned surface may be used to create uniform or substantially uniform luminance through reflection, absorption and/or scattering.

Figure 4:
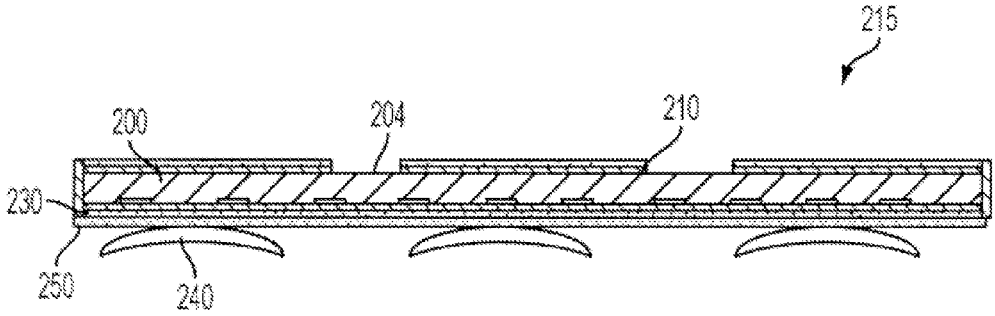
FIG. 4 depicts an exemplary dome sheet with a reflective layer according to an embodiment.

FIG. 4 depicts an exemplary dome sheet 215 with a reflective layer according to an embodiment. In an embodiment, reflective material 230 may be disposed adjacent to a substance 210. A reflective material may have a low refractive index. Reflective material may be, but is not limited to, specular material. Specular material may be strategically placed on one or more walls of a light guide 200 to promote light propagation and to redirect light towards a specific area of the light guide 200. In an embodiment, illuminating the light guide 200 will illuminate a key placed above the light guide. Specular material may be used to redirect light towards the key. Specular material may be placed on walls of a light guide 200 to absorb, reflect, diffuse and/or scatter light through a light guide 200.

In an embodiment, specular material may be, but is not limited to, specular ink. In an embodiment, specular ink may be applied as a continuous coating. In an embodiment, specular ink may be applied in any pattern or random fashion, such as the form of dots. Optionally, the specular dots may vary in color, opacity and/or density. The color, opacity and/or density of the specular dot may affect the amount or direction of reflection of light back into the light guide 200.

A dome sheet 215 may include one or more moveable contacts 240. In an embodiment, a movable contact 240 may include, but is not limited to, a snap dome. One or more moveable contacts 240 may be attached to a wall of a light guide 200. For example, a movable contact 240 may be attached to a second wall 204 of a light guide 200. In an embodiment, one or more moveable contacts 240 may be attached directly to the second wall 204 of the light guide 200. In an embodiment, one or more movable contacts 240 may be attached to a substance 210, a reflective material 230 and/or an adhesive 250.

Figure 5:
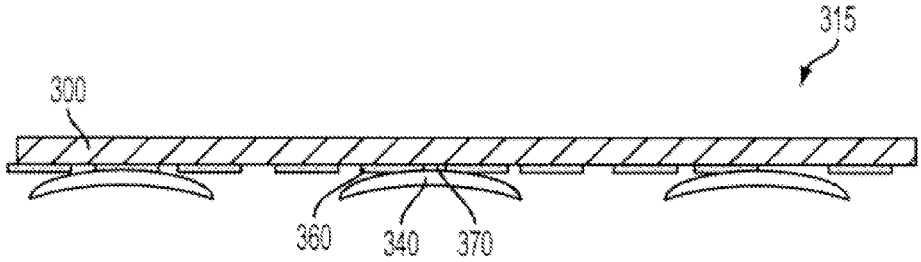
FIG. 5 depicts an exemplary dome sheet with a patterned adhesive according to an embodiment.

FIG. 5 depicts an exemplary dome sheet 315 with a patterned adhesive according to an embodiment. A patterned adhesive 360 may bond a light guide 300 to one or more moveable contacts 340. In an embodiment, a patterned adhesive 360 may be a light reflecting and/or absorbing adhesive. In an embodiment, a patterned adhesive 360 may have a lower refractive index than the light guide 300. A patterned adhesive 360 may scatter light within a light guide 300. A patterned adhesive 360 may include one or more spaced spots, regions, columns, ridges and/or other features.

In an embodiment, a patterned adhesive 360 may bond a light guide 300 to a moveable contact 340 to form one or more gaps 370 between the one or more moveable contacts 340 and the light guide 300. In an embodiment, the one or more gaps 370 may form a channel between a plurality of moveable contacts 340, for example if another contract were located behind the illustrated contacts as in an array. In an embodiment, the gap may be, but is not limited to, an air gap. In an embodiment, one or more gaps 370 may be sealed inside the dome sheet 315 by bonding the light guide 300 to the movable contact 340. In an embodiment, a patterned adhesive 360 may include a plurality of adhesive regions having a reflective property and position so that at least some light, when reflected from any of the regions may be reflected at an angle less than a critical angle of the light guide 300. In an embodiment, a patterned adhesive 360 may include one or more gaps 370 positioned between a plurality of adhesive regions so that the one or more gaps 370 cause total internal reflection inside the light guide 300.

Figure 6:
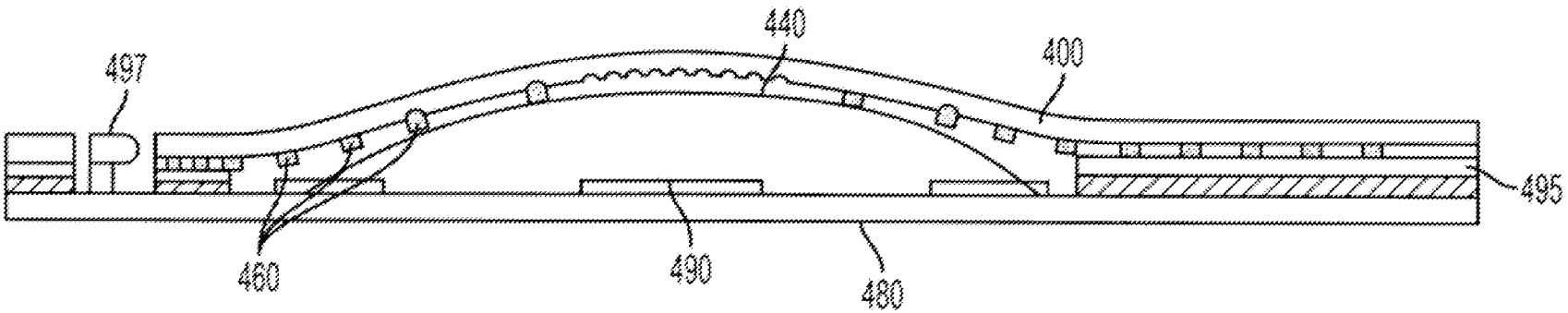
FIG. 6 depicts an exemplary membrane switch according to an embodiment.

FIG. 6 depicts an exemplary membrane switch according to an embodiment. In an embodiment, a membrane switch may include a dome sheet with a light guide 400, a movable contact 440 and a patterned adhesive 460. In some embodiments, the light guide 400 may be disposed adjacent to the movable contact 440. In alternate embodiments, the movable contact 440 may be disposed adjacent to reflective material. In an embodiment, a movable contact 440 may be disposed near the light guide 400 such that the movement of the light guide 400 moves the moveable contact 440. In an embodiment, a patterned adhesive 460 may bond a movable contact 440 to a light guide 400. As in the dome sheet, a patterned adhesive 460 may form one or more gaps between a movable contact 440 and a light guide 400.

A membrane switch may include a circuit board 480. In an embodiment, a circuit board 480 may include a plurality of fixed contacts 490. Fixed contacts 490 may be, but are not limited to, electrical contacts. In an embodiment, a movable contact 440 may be positioned over one or more fixed electrical contacts 490. The moveable contact 440 may touch a fixed electrical contact 490 when depressed. However, the moveable contact 440 may not touch the fixed electrical contact 490 when relaxed.

Optionally, the membrane switch may include a spacer 495. A spacer 495 may surround a plurality of fixed electrical contacts 490. A spacer 495 may be positioned between a circuit board 480 and a patterned adhesive 460. In an embodiment, a spacer 495 may be positioned to attach to a light guide 400 in areas where no movable contacts 440 are in contact with the light guide 400.

The membrane switch may include a light source 497. A light source 497 may pass light into a light guide 400. A light source 497 may be, but is not limited to, a light emitting diode (LED). A light source 497 may illuminate a light guide 400. A light source 497 may be positioned in a hole inside a patterned adhesive 460. In an embodiment, a light source 497 may lie directly against a circuit board 480.

In an embodiment, a light source 497 may be aligned with a light guide 400 to ensure that light from the brightest part of the light source 497 enters the light guide 400. In an embodiment, a light source 497 may be securely fixed. For example, a light source 497 may be bonded to a light guide 400. A securely fixed light source 497 may eliminate misalignment between the light source 497 and the light guide 400. Additionally, a fixed light source 497 may be in close proximity to the light guide 400, decreasing the amount of light which may be absorbed or scattered by other layers of the membrane switch.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A membrane switch, comprising:

a flexible light guide having a first refractive index, the flexible light guide comprising:

a first wall, an opposing second wall, and one or more additional walls, wherein one or more of the first wall, the second wall and the additional walls are disposed adjacent to a substance comprising a second refractive index that is lower than the first refractive index, and wherein the light guide further comprises a reflective material disposed adjacent to the substance having the second refractive index.

2. The membrane switch of claim 1 wherein:

the substance having the second refractive index is disposed adjacent to the first wall, and the first wall comprises a patterned surface.

3. The membrane switch of claim 1 wherein the first wall comprises one or more moveable contacts.

4. The membrane switch of claim 1, further comprising:

one or more moveable contacts attached directly to the first wall via an adhesive layer.

5. The membrane switch of claim 1, further comprising:

one or more moveable contacts attached to the substance having the second refractive index.

6. The membrane switch of claim 1, further comprising:

a movable contact disposed such that movement of the first wall will move the movable contact; and a circuit board comprising a plurality of fixed electrical contacts, wherein the moveable contact is positioned over a first one of the fixed electrical contacts so that the moveable contact touches the first fixed electrical contact when depressed and does not touch the first fixed electrical contact when relaxed.

7. The membrane switch of claim 1 wherein the reflective material is specular.

8. The membrane switch of claim 1 wherein:

the substance having the second refractive index is disposed adjacent to the first wall, and the first wall comprises an uneven surface which manages light reflected from the second wall.

9. The membrane switch of claim 8 wherein the uneven surface comprises at least one of:

a plurality of bumps, dimples, scratches, hash marks, textures, depressions, or holes.

10. The membrane switch of claim 8 wherein a substance having the second refractive index is also disposed adjacent to the second wall.

11. A dome sheet, comprising:

a light guide;

a plurality of moveable contacts; and a patterned adhesive which the bonds the light guide to the moveable contacts so that the patterned adhesive forms one or more gaps between the moveable contacts and the light guide;

wherein the light guide comprises a first wall and an opposing second wall, the first wall is bonded to the patterned adhesive and the second wall comprises a flexible, reflective material.

12. The dome sheet of claim 11 wherein the first wall comprises an uneven surface and the uneven surface of the first wall comprises at least one of:

a plurality of bumps, dimples, scratches, hash marks, applied patterns, textures, depressions, or holes.

13. The dome sheet of claim 11 wherein the first wall comprises a patterned surface.

14. The dome sheet of claim 11 wherein the one or more gaps in the patterned adhesive form a channel between a plurality of moveable contacts.

15. The dome sheet of claim 11 wherein the patterned adhesive comprises a plurality of adhesive regions having a reflective property, and wherein the plurality of adhesive regions form the one or more gaps.

16. The dome sheet of claim 11, further comprising:

a spacer positioned to attach to the light guide in areas where no movable contacts are in contact with the light guide.

17. The dome sheet of claim 11 wherein the patterned adhesive comprises a light reflecting adhesive.

18. The dome sheet of claim 11 wherein the one or more gaps are sealed inside the dome sheet.

19. A membrane switch, comprising:

a circuit board comprising a plurality of fixed electrical contacts;

a moveable contact positioned over a first one of the fixed electrical contacts so that the moveable contact touches the first fixed electrical contact when depressed and does not touch the first fixed electrical contact when relaxed;

a patterned adhesive bonded to the moveable contact; and a light guide bonded to the patterned adhesive, wherein the patterned adhesive bonds the light guide to the moveable contact so that the patterned adhesive forms one or more gaps between the moveable contact and the light guide.

* * * * *